US007934555B2

(12) United States Patent
Morton

(10) Patent No.: US 7,934,555 B2
(45) Date of Patent: May 3, 2011

(54) MULTIPLE ZONE ISOLATION METHOD

(75) Inventor: Robert D. Morton, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/475,928

(22) Filed: Jun. 1, 2009

(65) Prior Publication Data

US 2010/0300686 A1 Dec. 2, 2010

(51) Int. Cl.
*E21B 43/04* (2006.01)
*E03B 3/18* (2006.01)

(52) U.S. Cl. ..... 166/278; 166/257; 166/227; 166/51; 166/56

(58) Field of Classification Search ..... 166/278, 166/257, 227, 51, 56
See application file for complete search history.

(56) References Cited

U.S. PATENT DOCUMENTS

| | | | | |
|---|---|---|---|---|
| 5,392,850 | A | 2/1995 | Cornette et al. | |
| 5,507,345 | A | 4/1996 | Wehunt et al. | |
| 6,318,465 | B1 | 11/2001 | Coon et al. | |
| 6,619,397 | B2 | 9/2003 | Coon et al. | |
| 2003/0079878 | A1* | 5/2003 | Pramann et al. | 166/278 |
| 2003/0230406 | A1* | 12/2003 | Lund | 166/278 |
| 2007/0114027 | A1 | 5/2007 | Yeh et al. | |
| 2008/0142218 | A1* | 6/2008 | Rytlewski et al. | 166/278 |
| 2008/0164026 | A1 | 7/2008 | Johnson | |

OTHER PUBLICATIONS

Corbett, T. Gary, et al., "Multiple Zone Open Hole Gravel Packing Techniques with Zonal Isolation", SPE 77214, Sep. 2002, 1-12.
Coronado, Martin P., et al., "Advanced Openhole Completions Utilizing a Simplified Zone Isolation System", SPE 77438, Sep. 2002, 1-11.
Vickery, E. Harold, et al., "Application of One-Trip Multi-Zone Gravel Pack to Maximize Completion Efficiency", SPE 64489, Oct. 2000, 1-10.
Coronado, Martin P., et al., "Beta-Wave Pressure control Enables Extended-Reach Horizontal Gravel Pack", SPE 71668, Sep. 2001, 1-13.
Bayne, Christian, et al., "One-trip multi-zone gravel packing covers zones quickly", Offshore-mag.com, vol. 60, Issue 7, Jul. 2000, 7 pages.

* cited by examiner

*Primary Examiner* — Daniel P Stephenson
*Assistant Examiner* — Yong-Suk Ro
(74) *Attorney, Agent, or Firm* — Steve Rosenblatt

(57) ABSTRACT

Multiple producing zones separated by a non-producing zone are gravel packed together. The non-producing zone has locations to take returns so as to get a consistent pack in the non-producing zone. The production string features external seals and/or an internal plug so that no matter which producing zone is aligned to produce, the screens in the non-producing zone are selectively isolated so that the producing zone that is not intended to be produced has only the path through the gravel pack to get to the actual zone being produced. Since the annulus can be long and full of gravel this path will make flow from the zone that is not of interest minimal into the flow from the zone of interest without using a packer between pairs of spaced apart producing zones.

10 Claims, 4 Drawing Sheets

MULTIPLE ZONE ISOLATION METHOD

FIELD OF THE INVENTION

The field of the invention is multi-zone subterranean completions and more particularly those that are performed in a single trip where the gravel itself rather than an external packer provides zonal isolation.

BACKGROUND OF THE INVENTION

Producing zone completions involve insertion of a screen assembly that can be as long as several pay zones with long non-producing formations in between the producing zones. The surrounding annulus around the screens is filled with gravel using a tool called a crossover tool that takes the gravel slurry coming down the tubing string from the surface and redirects it out to the annular space below an isolation packer and outside the screen. The gravel remains in the annular space outside the screens while the carrier fluid goes through the screen and into a wash pipe connected to the crossover. The crossover allows the returning fluid to get through the isolation packer and back to the surface through the upper annular space above the isolation packer.

If the producing zones are far apart, the length of borehole between them is spanned by blank pipe and a packer that allows the screen sections to be properly located at the various producing locations. Typically the delivered gravel goes to the furthest (lowest) screen downhole and fills the annulus around it. When that screen is covered, the crossover tool and wash pipe are shifted to allow the setting of a packer in the annulus (between the two zones) to fully isolate the lower zone before further gravel deposition fills the non-producing zone. After the packer is set, pumping of the slurry is resumed, and gravel is deposited on top of the packer, while the returning fluid finds another path of least resistance and starts going through the next higher production screen as the lowermost screen now fully surrounded by gravel is said to "screen out" or resist flow to an extent that sends the returns to the next higher screen. This technique is illustrated in IACC/SPE 77214 by Corbett and Vickery entitled Multiple Zone Open Hole Gravel Packing Techniques with Zonal Isolation. It is limited to separating two zones with a packer in a single trip but is impractical for more than two zones.

US Publication 2008/0164026 shows a method of gravel packing multiple zones together and then setting packers into the gravel pack to isolate the producing zones.

What is needed and not available is a way to more economically perform a gravel pack of multiple zones that are spaced apart and get a good pack in an intervening non-producing zone while getting effective zonal isolation in the pack between the producing zones without employing packers. Those skilled in the art will appreciate each of the aspects of the present invention, some of which are individually listed above, from a review of the detailed description of the preferred embodiment and the associated drawings while recognizing that the full scope of the invention is to be found in the appended claims.

SUMMARY OF THE INVENTION

Multiple producing zones separated by a non-producing zone are gravel packed together. The non-producing zone has locations to take returns so as to get a consistent pack in the non-producing zone. The production string features external seals and/or an internal plug so that no matter which producing zone is aligned to produce, the screens in the non-producing zone are selectively isolated so that the producing zone that is not intended to be produced has only the path through the gravel pack to get to the actual zone being produced. Since the annulus can be long and full of gravel this path will make flow from the zone that is not of interest minimal into the flow from the zone of interest without using a packer between pairs of spaced apart producing zones.

DETAILED DESCRIPTION OF THE PREFERRED EMBODIMENT

Figure 1:
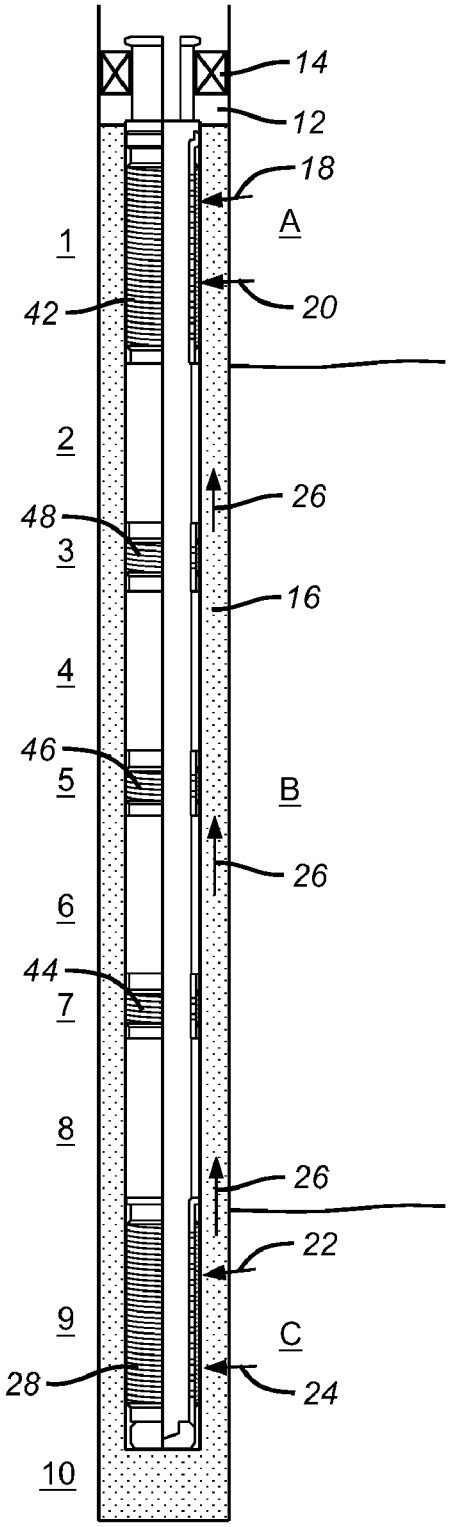
FIG. 1 shows two producing zones with a non-producing zone in between where the annulus is fully gravel packed.

FIG. 1 shows producing zone A separated from producing zone C by non-producing zone B. The entire illustrated wellbore is divided into regions 1-10 to simplify the discussion of how the gravel packing will proceed. It should be noted that while two producing zones A and C are shown separated by a non-producing zone B, the pattern can repeat and the distance between producing zones can vary and can be many meters down to a very small gap. The basic idea is to limit cross flow between zones A and C when only one is desired to be produced without using barriers in the annulus 12 below the production packer 14. The annulus 12 is filled with gravel 16. If only one of zones A and C are aligned to produce such as, for example if zone A is aligned to produce as indicated by arrows 18 and 20, any flow from zone C indicated by arrows 22 and 24 will only be able to reach zone A through the annulus 12, as indicated by arrows 26. Zone C will not flow into producing screen 28 because the production string 30 can have a plug 32 at its lower end 34 when the string 30 has its lower end shown in FIG. 2 inserted into a sealing relationship with the production packer 14 shown in FIG. 1. The string 30 has a sliding sleeve 38 to selectively cover port 40. The sleeve 38 can be initially in the desired position and can be shifted with a known shifting tool either initially to open it as well as subsequently to close it to isolate any desired zone for a variety of reasons, such as when it produces excess water, for example. When the string 30 is inside packer 14, the ported sub 36 is opposite screen 42 in zone A. If it is known from the beginning that zone A is to be produced first, the port 40 can be run in open and the plug 32 in position at the lower end 34 of the string 30. While attaining a no flow condition from zone C to zone A when producing only from zone A would be ideal, there may be some minimal amount of infiltration from zone C to zone A through the gravel 16 in annulus 12. The flow resistance between the producing formations A and C depends on many variables such as the distance between them, the density of the packed gravel, the fluid viscosity and the gravel particle size and void volume, to name a few variables.

One of the features of the invention is to get a good gravel pack in the zone B. Normally, there is just blank pipe and a packer between producing screens 28 and 42 in prior systems. This mean that when the gravel gets to the point of causing screen 28 to screen out, the slurry fluid that carries the gravel has to return to the surface from screen 42 as it then becomes the path of least fluid resistance. What this means is that gravel and carrier fluid separate at screen 42 and the gravel has only gravity to carry it down the annulus 12 below the producing screen 42. As a result the pack density of the gravel 16 between screens 42 and 28 is not optimally high.

Figure 3:
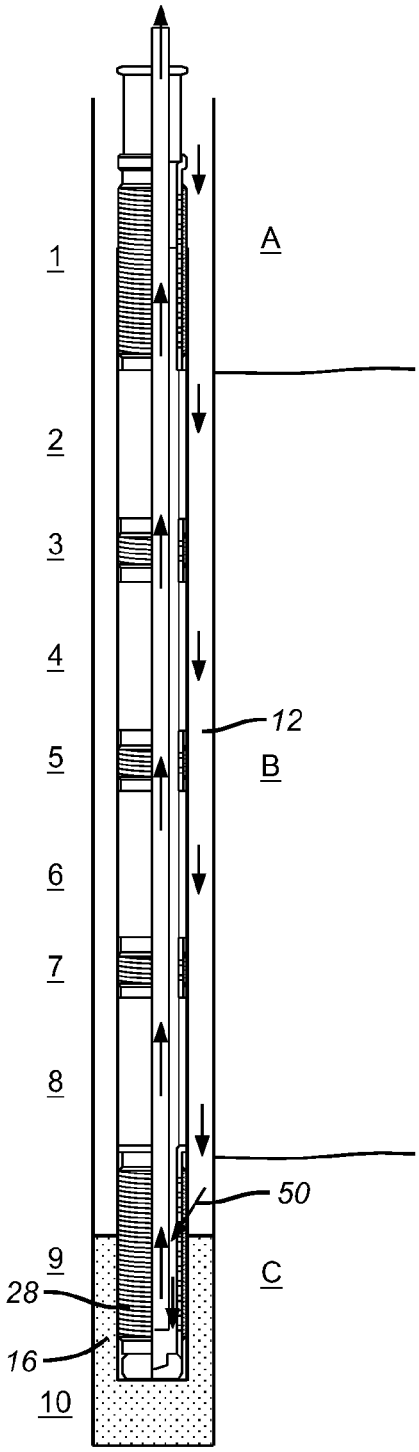
FIG. 3 shows the start of the gravel pack in zone C.
Figure 4:
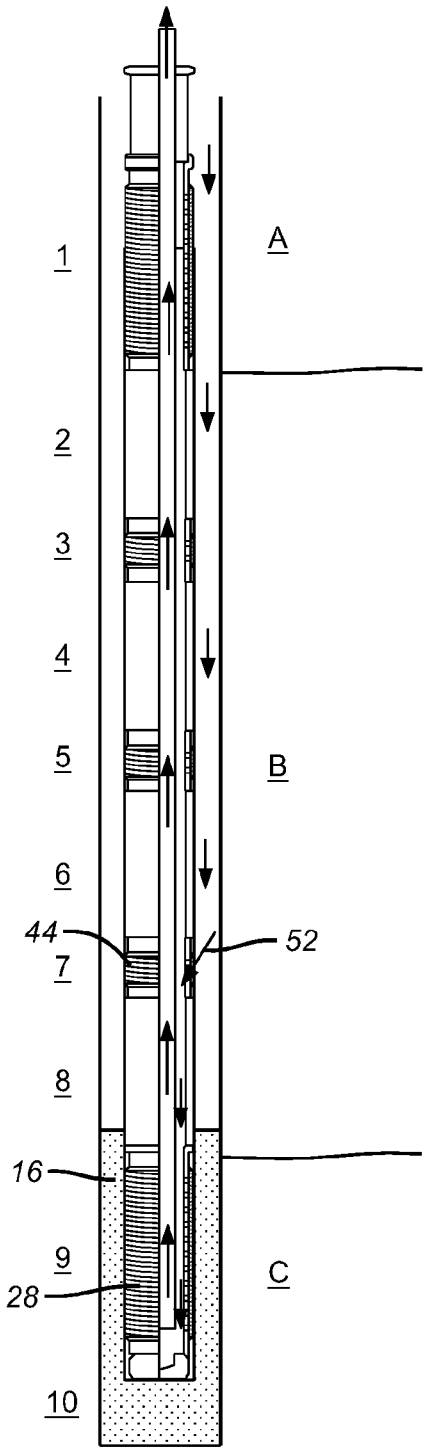
FIG. 4 is the view of FIG. 3 with the zone C gravel pack finished.
Figure 5:
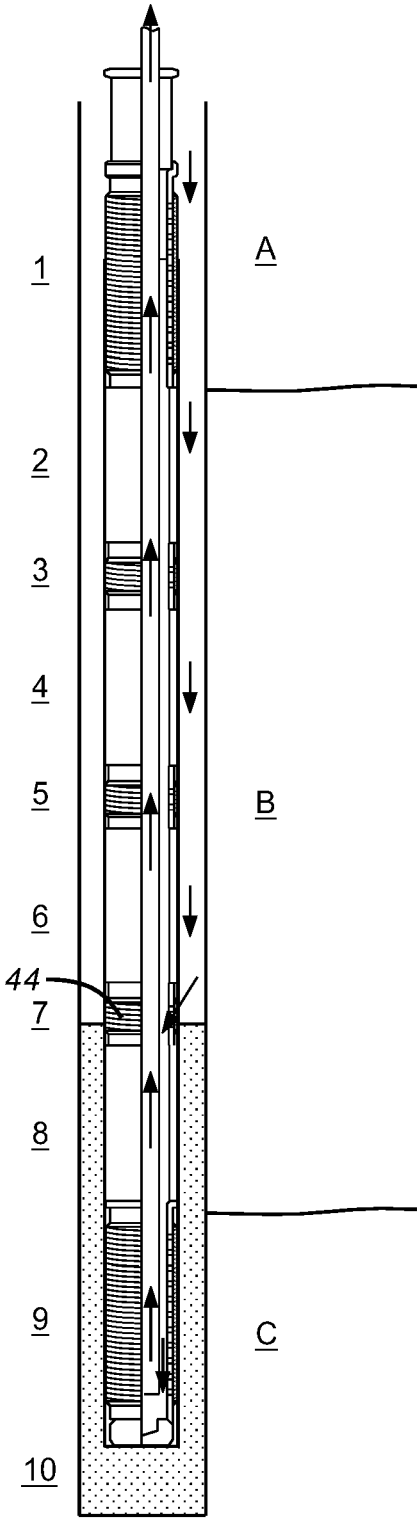
FIG. 5 is the view of FIG. 4 with the start of gravel packing zone B with returns coming through the screen in location 7.
Figure 6:
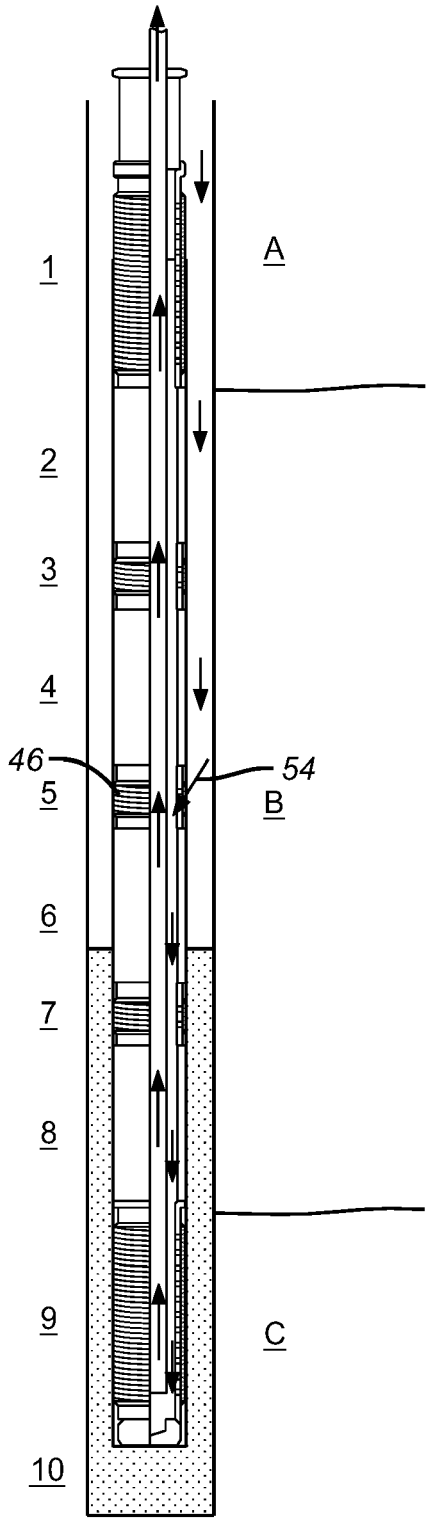
FIG. 6 is the view of FIG. 5 with the gravel pack advanced beyond the screen in zone 7.
Figure 7:
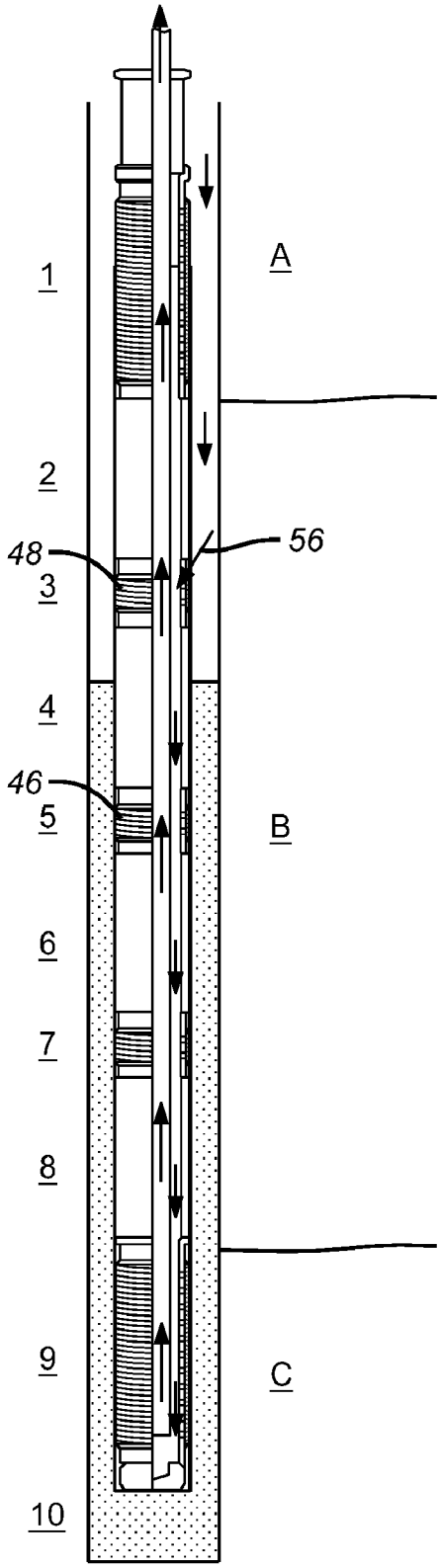
FIG. 7 is the view of FIG. 6 with the gravel pack advanced beyond the screen in zone 5.
Figure 8:
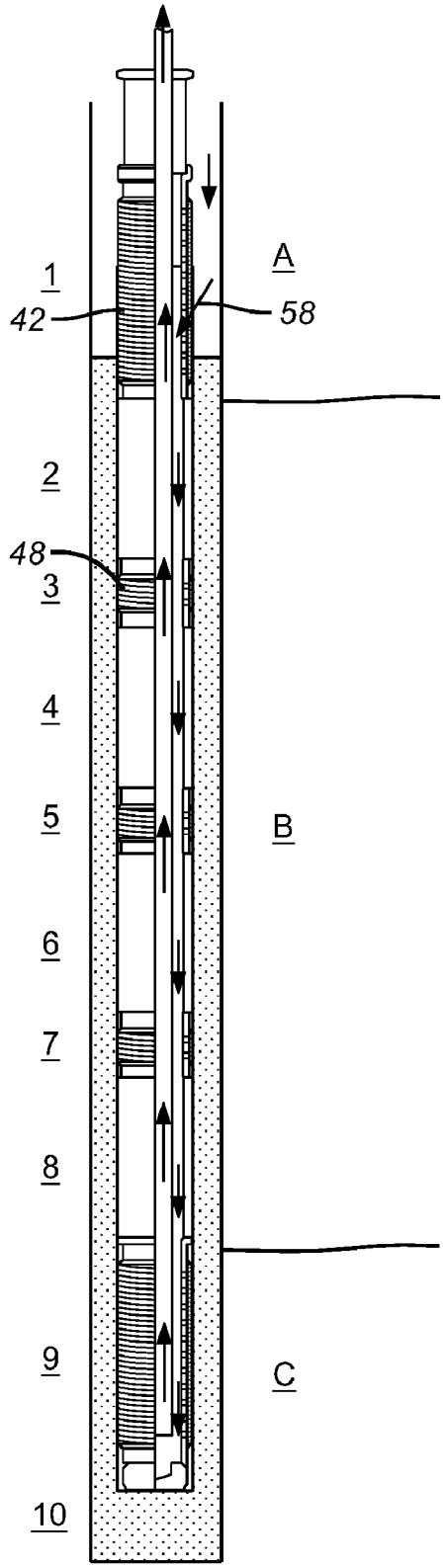
FIG. 8 is the view of FIG. 7 with the gravel pack advanced into the producing zone A.

In the present invention, there are completion screens such as 44, 46 and 48 located respectively at regions 7, 5 and 3. The spacing of these screens and their individual length can vary as can the number of such non-producing zone B seal bores 2,4,6, and 8. The screens 44, 46 and 48 should be shorter than the production screens 28 and 42 due to their limited service during gravel packing but they can also be the same size or larger. The objective is that after screen 28 is covered by gravel 16 and the gravel packing continues, that there are enough return locations for the fluid carrying the gravel to return to the surface at different locations so as to continue to use the fluid velocity to carry the gravel 16 into the non-producing zone B as it fills the annulus 12 in a direction from screen 28 to screen 42.This is shown graphically in FIGS. 3-8. In FIG. 3, the gravel covers about half of screen 28 and fluid represented by arrow 50 that carried the gravel in annulus 12 passes through the screen 28 and returns to the surface through the packer 14 and a crossover (not shown) through the annulus above the packer 14. In FIG. 4 the screen 28 has screened out and the returns represented by arrow 52 enter screen 44 as the gravel 16 builds above the level of screen 28 and into the non-producing zone B. In FIG. 5 the gravel 16 has reached screen 44. In FIG. 6, screen 44 has screened out and returns represented by arrow now pass through screen 46. In FIG. 7, screen 46 has screened out and returns represented by arrow 56 go through screen 48. In FIG. 8, screen 48 has screened out and returns represented by arrow 58 enter through screen 42. Continuing the gravel packing until screen 42 screens out will produce a fully gravel packed annulus 12 with gravel 16 over the top of screen 42.

Figure 2:
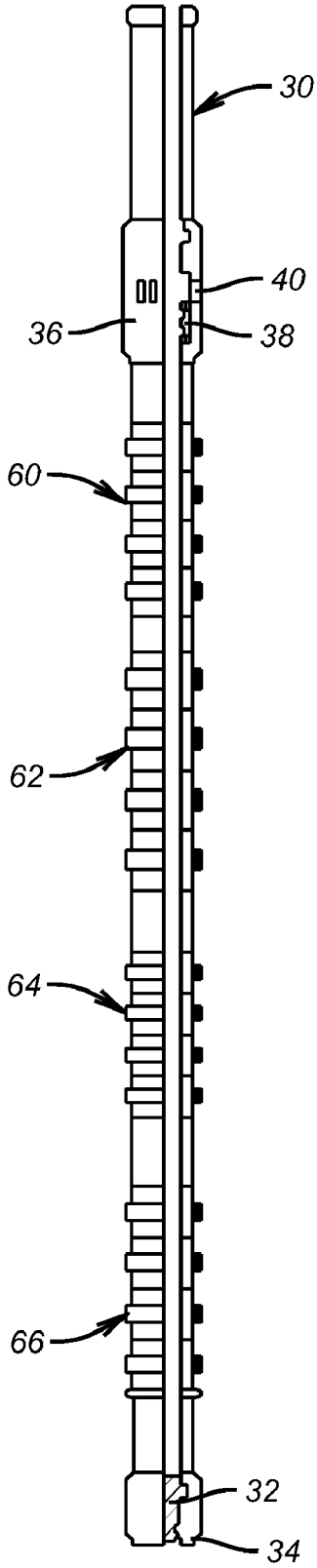
FIG. 2 is the lower part of the production string that fits into the completion in FIG. 2 to isolate the screens in the non-producing zone and to make access between zones A and C possible only through the gravel pack in the annulus.

With the gravel pack complete as shown in FIG. 1 the crossover and any wash pipe attached (not shown) are removed and the production string of FIG. 2 is inserted into the packer 14. When that happens, seal assemblies 60, 62, 64 and 66 are placed respectively in regions 2, 4, 6 and 8 so that every screen 44, 46, and 48 is straddled so that no flow can come through it. It essentially converts the portion of the completion in FIG. 1 between screens 28 and 42 into blank pipe. It also provides flow access into the string 30 through its lower end 34 if there is no plug 32 there so that flow can occur into screen 28 from zone C. Alternatively, the port 40 can be put into or already be in the open position to allow flow from zone A while shutting the lower end 34 with plug 32 to block flow from zone C into screen 28.

The seal assemblies 60, 62, 64 and 66 can have one or more external seals to the string 30. The seal type can vary as long as the objective of isolating the screens 44, 46, and 48 from flow is accomplished after the gravel packing is completed. Screens 44, 46, and 48 can be small openings of any shape size and number so as to prevent gravel from getting through during gravel packing. These screens are spaced apart so that the seal assemblies 60, 62, 64 and 66 can land on blank pipe to seal in regions 2, 4, 6 and 8. The lower end 34 is in region 9 inside the screen 34. If plug 32 is used it can be subsequently removed in a variety of ways. If desired, the zone A and C can be produced together. Any number of producing zones can be completed in this manner and produced in any desired order by manipulating sliding sleeves such as 38 in ported subs 36 that can be positioned in any of the producing zones. The lowermost zone is preferably produced through an opening at the bottom of the string 30.

When the annulus 12 is tightly packed due to the presence in the non-producing zone of return screens 44, 46, and 48 the migration flow between adjacent producing formations can be as low as a few barrels per day or with optimal low pressure differentials between adjacent formations and long spacing between them it is conceivable to effectively get to a no cross flow situation between adjacent producing zones. Clearly, the longer the spacing and the smaller the open hole annulus and the tighter the gravel pack, the amount of cross flow between producing formations is minimized if not eliminated.

While production is mentioned through screens 28 and 42, the term "production" encompasses flow in the reverse direction is contemplated such as in a fracturing mode or in an injection mode such as with steam, for example.

The above description is illustrative of the preferred embodiment and various alternatives and is not intended to embody the broadest scope of the invention, which is determined from the claims appended below, and properly given their full scope literally and equivalently.

I claim:

1. A method of subterranean completion, comprising:

locating a production screen adjacent each of at least two spaced apart producing zones with said production screens connected with a connecting tubular extending between them and said connecting tubular extending through a non-producing zone to define an annulus that spans said zones;

providing in said connecting tubular at least one screened opening;

depositing gravel in said annulus adjacent said non-producing zone while taking fluid returns through said screened opening;

connecting a production string comprising external spaced barriers to straddle said production screens;

isolating said screened opening while said screened opening is open between said spaced barriers while producing through an opening in said production string that is located outside the portion of said production string between said spaced barriers, said opening aligned with at least one said production screen;

using only said deposited gravel to control flow between said producing zones through said annulus while one of said producing zones is producing through its associated production screen and into said production string.

2. The method of claim 1, comprising:

providing an opening at the lower end of said production string to create a flowpath between said second production screen and the surface.

3. The method of claim 2, comprising:

plugging said opening at said lower end of said production string;

producing through said first production screen while isolating said second production screen with said plugging.

4. The method of claim 3, comprising:

isolating said first production screen after producing through said first production screen;

unplugging said lower end of said production string after isolating said first production screen;

producing through said second production screen after said unplugging of said lower end of said production string.

5. The method of claim 2, comprising:

closing said production port in the wall of said production string while leaving said lower end open;

producing first through said second production screen while said first production screen is isolated.

6. The method of claim 5, comprising:

plugging said lower end of said production string after producing through said second production screen and thereafter opening said production port in the wall of said production string to subsequently produce from said first production screen.

7. The method of claim 1, comprising:

providing at least one selectively operated closure on said port in the wall of said production string.

8. The method of claim 7, comprising:

using a sliding sleeve for selective closure of said port.

9. The method of claim 1, comprising:

using no packers outside said connecting tubular.

10. The method of claim 1, comprising:

providing a plurality of seals on said production string to be disposed on either side of said opening in said connecting tubular so as to serve as backup for each other and to force any flow from one producing zone to the other to flow first through said gravel packed annular space.

* * * * *